US007382385B2

(12) United States Patent
Breen et al.

(10) Patent No.: US 7,382,385 B2
(45) Date of Patent: Jun. 3, 2008

(54) SKEWING COMPENSATION METHOD AND APPARATUS IN A LASER BASED IMAGE-FORMING SYSTEM

(75) Inventors: Craig Breen, Rehovot (IL); Haim Livne, Kfar Saba (IL); Michael Plotkin, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 432 days.

(21) Appl. No.: 11/187,069

(22) Filed: Jul. 22, 2005

(65) Prior Publication Data

US 2007/0019059 A1 Jan. 25, 2007

(51) Int. Cl.
*B41J 2/435* (2006.01)

(52) U.S. Cl. ..... 347/116; 347/235

(58) Field of Classification Search ..... 347/116, 347/235, 250

See application file for complete search history.

(56) References Cited

U.S. PATENT DOCUMENTS 6,842,187 B2 * 1/2005 Shiraishi ..... 347/233

* cited by examiner

*Primary Examiner*—Huan H Tran
(74) *Attorney, Agent, or Firm*—Lee & Hayes, PLLC

(57) ABSTRACT

Skew compensation apparatus for compensating for skew of a multi-beam scanning source, comprises: delay commencement detector(s) for detecting the start of a beam scanner position, position detectors for detecting the position of the multiple beams at a predefined interval following the commencement, so that the position indicates skew of the respective beam, and compensating electronics for automatically inserting a compensation for the skew by altering a delay into a timing signal for switching the respective beam. The commencement detector can be an existing start of scan detector and the apparatus can be built into the writing head, particularly at the conjugate location to the focal plane or at the focal plane of a laser printer or the like to provide a self-calibrating printer.

18 Claims, 6 Drawing Sheets

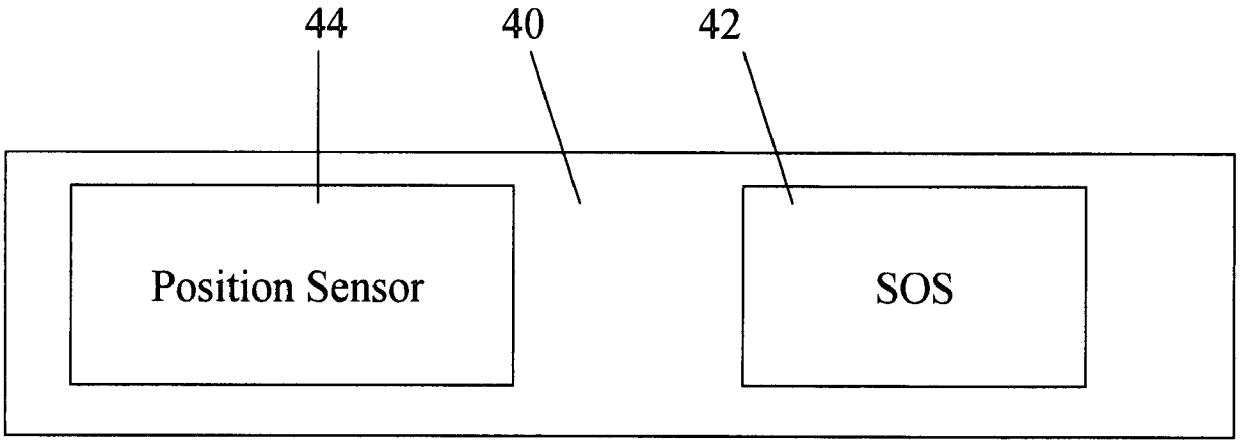
Fig. 6
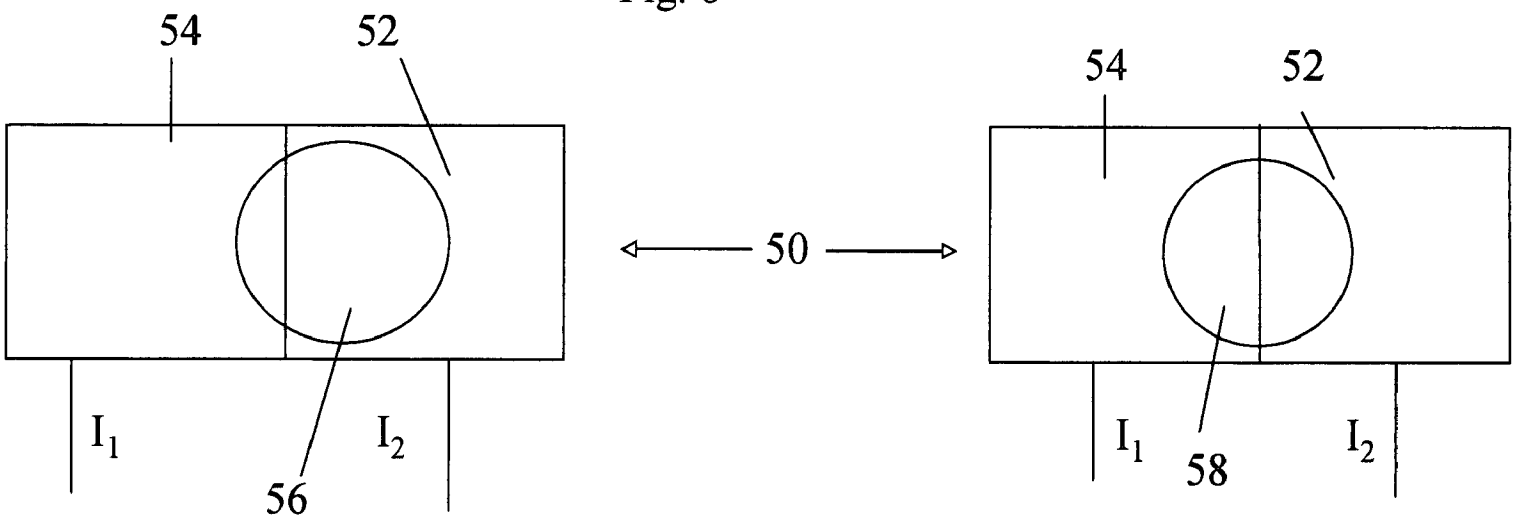
Fig. 8
Fig. 7

SKEWING COMPENSATION METHOD AND APPARATUS IN A LASER BASED IMAGE-FORMING SYSTEM

FIELD AND BACKGROUND OF THE INVENTION

The present invention relates to skewing compensation in a laser based image forming system, and, more particularly, to a technique for deskewing within a laser-based image forming system comprising a plurality of laser beams.

The formation and development of latent images on the surface of photoconductive materials using liquid or powder developing material is well known. The basic process involves placing a uniform electrostatic charge on photosensitive plate and exposing the layer to a light or to a scanning laser to dissipate the charge on the areas of the plate exposed to the light to form a latent electrostatic image.

An example of the known art is shown in FIG. 1. Generally speaking known art laser based printing system 10 uses a laser source 12 that produces a single beam 13 that is scanned optically over a photosensitive plate 14 using an optical element such as polygon 16. Incidence of the laser beam 13 on the plate discharges the plate 14 at points struck by the beam and a latent image is formed on the plate in accordance with the scanning of the beam. The result is an electrostatic image on the photosensitive plate 14.

In addition to the above, systems are known in which multiple laser beams are scanned simultaneously over the plate.

The resultant latent image is developed by subjecting the latent image to a liquid toner (in case of liquid ink development) comprising a carrier liquid and colored toner particles. Generally , the development is carried out in the presence of an electric field, such that the charged toner particles are attracted either to the charged or discharged areas, depending on the charge on the particles and the direction or the magnitude of the field.

This image is transferred by means of electrical field to an intermediate transfer member (ITM) 20 which is typically covered with a replaceable blanket 22. The blanket is kept at elevated temperature and the carrier liquid is evaporated. The resultant tacky ink film is transferred from the blanket, by thermal forced to a sheet 26 which is located onto impression drum 24. The transferred image is permanently affixed to the substrate by application of heat and pressure.

It should be mentioned that there are also systems which do not use a blanket. Instead they transfer the image directly from the photosensitive plate to the substrate.

A disadvantage of the device of FIG. 1 is that the single beam is required to scan and form the entire image, thereby acting as a limitation on the printing speed. In order to overcome this problem a multi-beam laser source was developed and the writing speed was thereby increased. Such a laser source is illustrated in FIG. 2. A single integrated circuit or chip or other aggregate of lasers 30 provides a multi-beam laser source, having a plurality of individual laser beam sources 32 which scan the image in parallel through polygon 16, forming simultaneously a group of scan lines. Each scan line corresponds to a respective individual laser beam. The laser source may be a diode laser array with individually addressable laser diodes. Such an array may be provided on a single integrated circuit.

Now, in modern high definition printing a typical spot or pixel size is approximately 31 microns, equivalent to a scan time of around 13 nanoseconds, although typically a range of 21 to 42 microns is found, and the scan times have a corresponding variation range. Even if it is physically possible to build the multi-beam laser source such that the individual laser sources are at the corresponding spacing, in our example at a 31/M micron interval or spacing,(M=3÷7 being a typical system optical magnification) but current manufacturing techniques mean that at such a scale the variation in the spacings between the individual sources is likely to be a large and noticeable percentage of the spacings themselves. It is therefore conventional to build a laser source with the spacings much larger than the required 31/M microns so as a result the spacing variations are a relatively small percentage error and then skew the source in the scan direction as shown in FIG. 3 to give the correct inter beam spacing. Typically this spacing is 100 micron. That is to say multi-beam source 40 is skewed against the direction of scan indicated by arrow 42 so that the skew angle effectively cancels out the manufacturing error in the spacings between the laser sources.

Now it will be appreciated that printing a straight vertical line, vertical meaning orthogonal to the scanning direction, using the skewed source in FIG. 3 requires that the successive laser beams are switched with successively increasing delays, since each successive beam reaches the same position in the scan later due to the skew. The process of altering the timing of the beams to compensate for the skew is known as deskewing.

In order to perform deskewing there are numerous factors that need to be taken into account. The delay needed by the different beams due to the physical spacing in the horizontal direction multiplied by optical system magnification, is one issue. Secondly there are electrical switching delays in the circuitry, specifically electronic delay in the driver board, which mean that there is a finite delay between the instant a particular beam is switched electronically and the moment the optical beam is produced. The delay is variable depending on the specific board and is due to factors such as parasitic capacitance that can vary between boards.

The extent to which each factor needs to be taken into account is the extent of the writing resolution accuracy, which is to say that typically the total spot size is equivalent to a scanning time of around 10-20 nanoseconds. In order to achieve such a resolution, issues of an order of magnitude below this should be considered. Such issues should therefore address positioning accuracy equating to a scan time of 1ns or better.

To date there are two methods being used for carrying out deskewing. First of all there is what may be termed "theoretical calculation" and is also referred to as an "open-loop" process. Theoretical calculation means simply building in the delay electronically in advance based on knowledge of the speed of rotation, the spacing between adjacent beams and the optical magnification. However theoretical calculation fails to deal adequately with optical magnification and also fails to deal at all with delays in the driver board since the driver boards are not sufficiently uniform. Two different driver boards can easily give very different delays, depending on parasitic capacitance and other effects as explained above. Thus the use of "theoretical calculation" results in print location errors that result in visual artifacts in the printed image. In particular in color images the visual artifacts come into existence due to interaction between grey scales between different screens.

A second method used to date for calibrating the deskewing involves carrying out a test operation in an optical laboratory, in which an attempt is made to print out an accurate straight line. The method takes advantage of the fact that straightness of a line is relatively easy to determine, simply by measuring using optical equipment. The resulting beam positions are measured in the focal plane of the system, and compensatory delays are applied until the line actually is straight. The Writing Head is then approved by the optical laboratory.

The optical laboratory method is relatively accurate, and it successfully takes into account all of the component parts of the delay in the beam, whether directly connected to the skew or otherwise, however it also has a number of disadvantages. First of all it is slow and costly to have to send each writing head to an optical laboratory and carry out accurate measurements if accurate calibration is needed. Secondly driver boards may be changed several times during the life of the writing head and it is not practical to recall the writing head for calibration every time a driver board is changed.

A third disadvantage of both methods is that parameters of the printer, including delays in the driver board, tend to drift over the lifetime of the printer. Thus even the most accurate determination of the deskew parameters in the laboratory prior to sale cannot be guaranteed to prevent the gradual appearance of artifacts in the printout over the life of the printer.

There is thus a widely recognized need for, and it would be highly advantageous to have, a skew compensation, or deskewing, system devoid of the above limitations.

SUMMARY OF THE INVENTION

According to one aspect of the present invention there is provided skew compensation apparatus for compensating for skew of a multi-beam scanning source, the apparatus comprising:

a delay commencement detector, such as a start of scan detector, for detecting a predetermined commencement indication of a scanning operation a position detector for detecting the position of at least one of the multiple beams at a predefined interval following the commencement indication, the position thereby indicating a skew of the beam, and compensating electronics for automatically inserting a compensation for the skew by altering a delay into a timing signal for switching the beam.

The delay commencement detector may be a start of scan detector.

The delay commencement indication may be the arrival of a start of scan beam at a start of scan detector.

The position detector is typically located in a focal plane of the multi-beam scanning source.

The position detector may be a split detector.

The split detector may be centered on a position indicative of full compensation of a respective beam for the skew.

Additionally or alternatively, the position detector is a charge-coupled device, or position sensing device (PSD) or a split detector or multi-element detector. There are other sensing devices which will occur to the skilled person.

There may be provided a plurality of position detectors, one for each beam of the multi-beam scanning source.

Each position detector may be centered on a position indicative of full compensation of a respective beam for the skew.

In an embodiment, the compensating electronics is configured to alter a respective beam delay in an iterative procedure to converge on a compensation solution.

The apparatus is preferably configured for automatic use in a calibration operation typically prior to the print formatting or scanning, but as a possibility may be carried out after the formatting.

In an embodiment, the delay commencement detector is located on the optically conjugated plane, but may or may not be on or close to the photo imaging plate (PIP).

The position detector may likewise be located on the PIP.

The position detector may be located integrally with the delay commencement detector.

The position detector of one embodiment is a split detector and is located integrally with the delay commencement detector.

The multi-beam scanning source may be a laser printer scanning source.

According to a second aspect of the present invention there is provided a method of skew compensation for scan beams in a multi-beam scanning apparatus, the method comprising:

for each beam, optionally, detecting a start of beam switching event;

measuring a time of a respective beam a default or predetermined position after the start of beam switching event; and altering a switching delay for the respective beam until the measured position is such as to indicate that skew in the beam has been compensated for.

According to a third aspect of the present invention there is provided skew compensation apparatus for compensating for skew of a multi-beam scanning source, the apparatus comprising:

delay commencement detection means for detecting a predetermined commencement indication of a beam switching delay, position detection means for detecting the position of at least one of the multiple beams at a predefined interval following the commencement, the position thereby indicating a skew of the beam, and compensating means for automatically inserting a compensation for the skew by altering a delay into a timing signal for switching the beam.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. Also included is firmware, for example using an ASIC, FPGA, CPLD, etc. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 6 shows a combination of a start of scan (SOS) detector and an additional position detector that can be placed in the conjugate plane of a photoimaging plate (PIP) in order to measure the delays for each beam at a calibration stage prior to print format, according to a first embodiment of the present invention;

FIG. 7 illustrates a split detector and how it can be used to provide the position detector of FIG. 6 and detect a position error;

FIG. 8 illustrates the split detector of FIG. 7 and how it can measure a substantially error-free beam;

DESCRIPTION OF THE PREFERRED EMBODIMENTS

Figure 1:
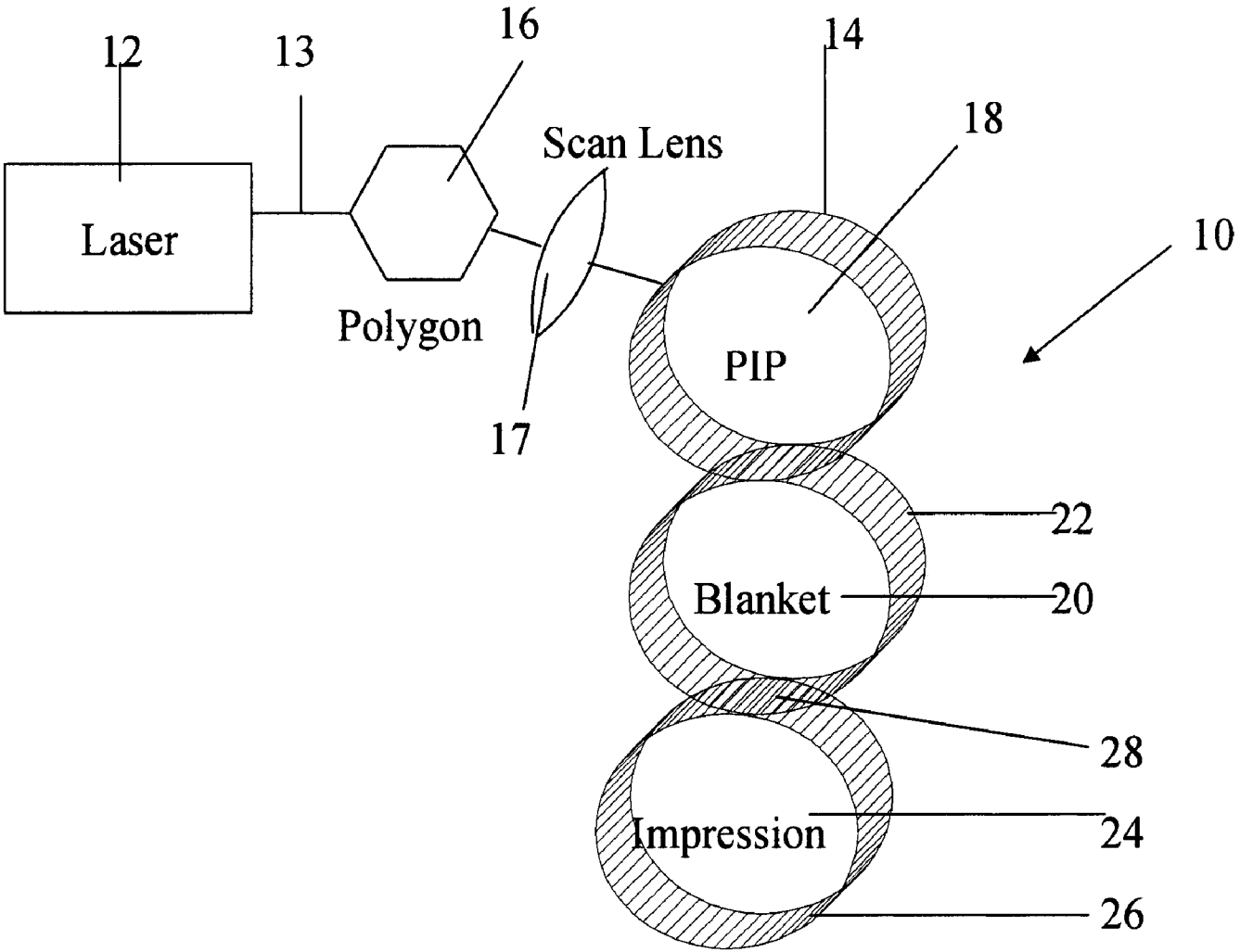
Fig. 1 Prior Art
FIG. 1 is a simplified diagram showing a prior art scan-based printing engine, with a scan beam, a scan lens, a polygon and three drums or cylinders.

The present embodiments comprise a system and method for deskewing which involves measuring the skew at the photo imaging plate (PIP). The actual skew can be measured whenever desired by using a position detector on the optical conjugate to the PIP plane, or possibly near or on the edge of the PIP, to measure the deviation of a beam from an intended position and to adjust the timing of switching of the beam so that the beam reaches the intended position. The measurement can be repeated as desired so that component drift over the lifetime of the device can be adjusted for. If the absolute delay time is needed then a difference can be measured between a start of scan detection and the detection at the position detector.

The principles and operation of a skew compensation or deskewing system according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1, which illustrates a prior art scan based printing engine, with a scan beam, a polygon, scan lens and three drums. As explained in the background, printing system 10 uses a laser source 12 that produces a single beam 13 that is scanned optically over a photosensitive plate 14 using an optical element such as polygon 16. Incidence of the laser beam 13 on the plate discharges the plate 14 at points struck by the beam and a latent image is formed on the plate in accordance with the scanning of the beam. The result is an electrostatic image on the photosensitive plate 14.

The photosensitive plate 14 is located on, and indeed forms the circumferential surface of a first drum 18 which counter-rotates with a second drum 20 that carries a blanket 22. Ink is drawn into the photostatic image on the first drum. The blanket 22 comes into contact with the ink image from the first drum and the ink on the first drum is transferred to the blanket surface.

The blanket drum 20 in turn counter-rotates with impression drum 24 on which a sheet or roll 26 of a print medium is located. A point 28, known as the nip, is the point at which the blanket and impression drum meet. The blanket 22 transfers the ink image, or printing image onto the print medium 24 as the print medium passes the nip, to form a printed image on the print medium 24.

Figure 2:
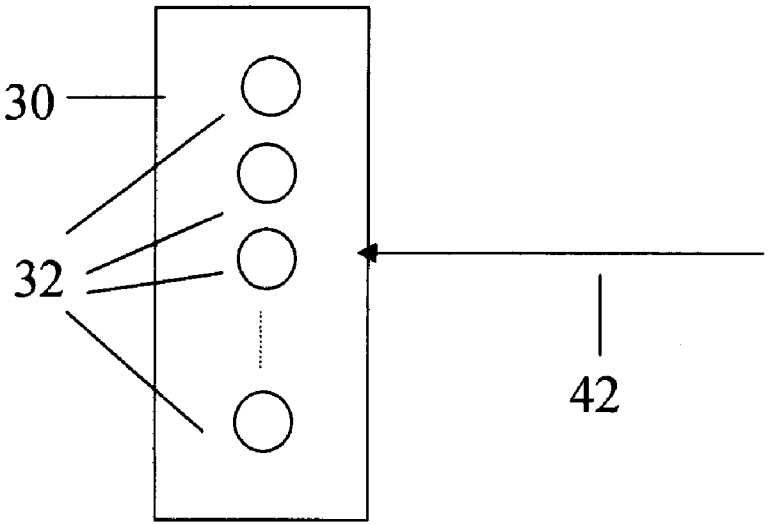
FIG. 2 is a simplified diagram illustrating a known multiple beam laser scanning source.

Reference is now made to FIG. 2, which illustrates a known multiple beam laser scanning source. As explained in the background, a single integrated circuit or chip or other light-generating structure 30 provides a multi-beam laser source, having a plurality of individual laser beam sources 32 which scan the image in parallel through polygon 16.

Figure 3:
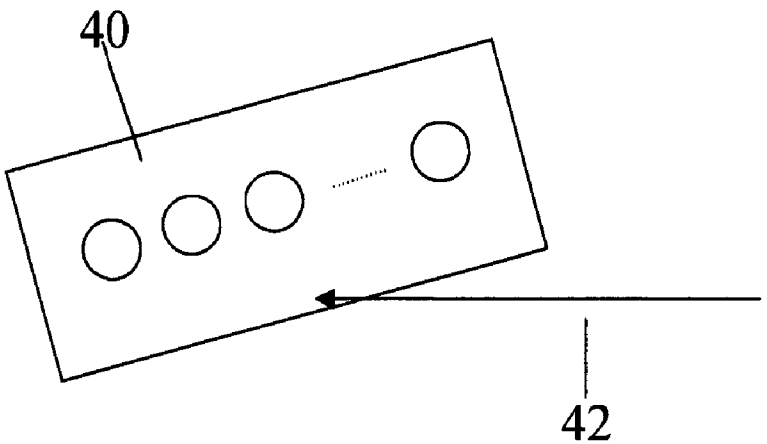
FIG. 3 is a simplified diagram illustrating the multiple beam laser source of FIG. 2 at a skew angle ready for scanning.

Reference is now made to FIG. 3, which illustrates the integrated circuit 30 in a skewed position for scanning. As explained in the background, in modern high definition printing the spot or pixel size can for example be approximately 31 microns, equivalent to a scan time of around 13 nanoseconds, although a range of between 21 and 42 microns is currently available for a spot size. Even if it is physically possible to build the multi-beam laser source such that the individual laser sources are at the exact spacings, in our example $31/M \approx 8$ micron intervals or spacings, but current manufacturing techniques mean that at such a scale the variation in the spacings between the individual sources is likely to be a large and noticeable percentage of the spacings themselves. It is therefore conventional to build a laser source with the spacings (typically 100 micron) to be much larger than the required 8 microns and then skew the source in the scan direction, as shown in FIG. 3, to give the correct inter beam spacing. That is to say multi-beam source 40 is skewed against the direction of scan indicated by arrow 42 so that the skew angle effectively cancels out the manufacturing error in the spacings between the laser sources.

Figure 4:
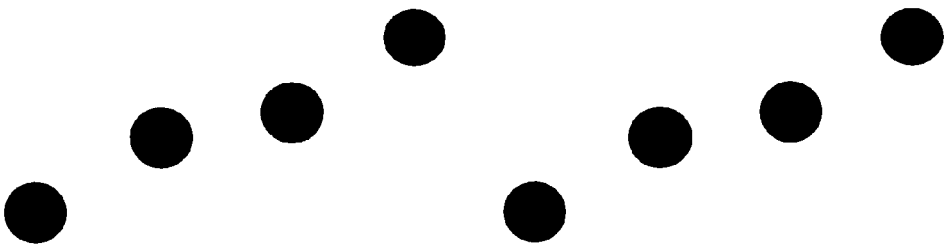
FIG. 4 is a simplified diagram illustrating in schematic form an uncorrected attempt to produce a straight line using a laser source as in FIG. 3.

Reference is now made to FIG. 4, which illustrates the effect of attempting to print a straight line when only paying minimal attention to the delays needed to be applied to each of the beams. As explained in the background, it will be appreciated that printing a straight line using the skewed source in FIG. 3 requires that the successive laser beams are switched with successively increasing delays, since each successive beam reaches the same scan line later due to the skew.

In order to carry out deskewing there are several factors that need to be taken into account. The delay needed by the different beams due to the physical dimensions of the horizontal displacement, is one issue. Secondly there is the optical definition, including optical enlargement at the optical scanning element 16. Thirdly there are electrical switching delays in the circuitry, specifically electronic delay in the driver board, which means that there is a finite delay between the instant a particular beam is switched electronically and the moment the optical beam is produced. The delay is variable depending on the specific board and is due to such factors as parasitic capacitance that can vary between boards.

The extent to which each factor needs to be taken into account is the extent of the writing resolution accuracy, which is to say that the total spot size is equivalent to a scanning time of around 13 nanoseconds. In order to achieve such a resolution, issues of an order of magnitude below this should be considered.

Figure 5:
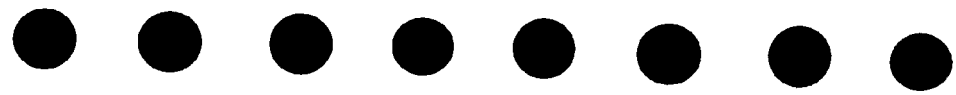
FIG. 5 is a simplified diagram illustrating in schematic form how suitable delays applied to each beam in FIG. 4 should be able to produce a substantially straight line.

Reference is now made to FIG. 5, which is a simplified diagram illustrative of how suitably measured, board specific deskewing delays allow a straight line to be formed rather than the slanted line of FIG. 4.

Reference is now made to FIG. 6, which is a simplified diagram illustrating a delay measurement arrangement according to a first embodiment of the present invention for measuring beam delay at the photo imaging plate or PIP. A selected plane which is optically conjugate to the PIP generally has an arrangement 40 which includes a start of scan detector (SOS) 42 which generates a scan start indication and thus is able to measure the exact moment at which a scan operation starts. According to an embodiment of the present invention a position detector 44 is located at a position optically conjugate to a position where a scan beam is expected to strike the plate after a predetermined delay if perfectly deskewed. If the scan beam hits the exact location of the detector then the delay applied to that beam is exactly right and no further adjustment is needed for that beam. If the scan beam misses the location then the delay needs to be adjusted until the position detector is struck exactly by the beam. Adjustment may involve artificially or proactively increasing or decreasing the switching delay for the beam. As will be explained, adjustment of the delay may be carried out in iterative steps until correct positioning is obtained.

Separate start of scan measurements and detection operations may be carried out for each of the scan beams so that each beam can be adjusted independently.

Reference is now made to FIGS. 7 and 8 which illustrate split detectors. Split detectors such as detector 50 are used for detection of light beams and comprise a detection surface which is divided into two regions 52 and 54. The detection surface is responsive to incident light in that it generates a current in proportion to the amount of light falling on the surface. In the split detector the two surface parts are isolated from each other so that separate currents $I_1$ and $I_2$ are generated for each part. Comparing the two currents of the two halves of the split detector is a way of providing very accurate alignment information regarding an incident beam. FIG. 7 illustrates a beam 56 which is not accurately aligned over the split detector 50 and FIG. 8 illustrates a beam 58 which is accurately aligned over the split detector 50. The skew alignment in such a case involves adding or reducing delays to the switching of the respective beam until it is correctly centered on the split detector 50.

Alternatives for the detection sensor may include the user of the charge coupled device CCD or PSD or photodiode or other sensors, provided they can provide high resolution detection at the scale in question.

Figure 9:
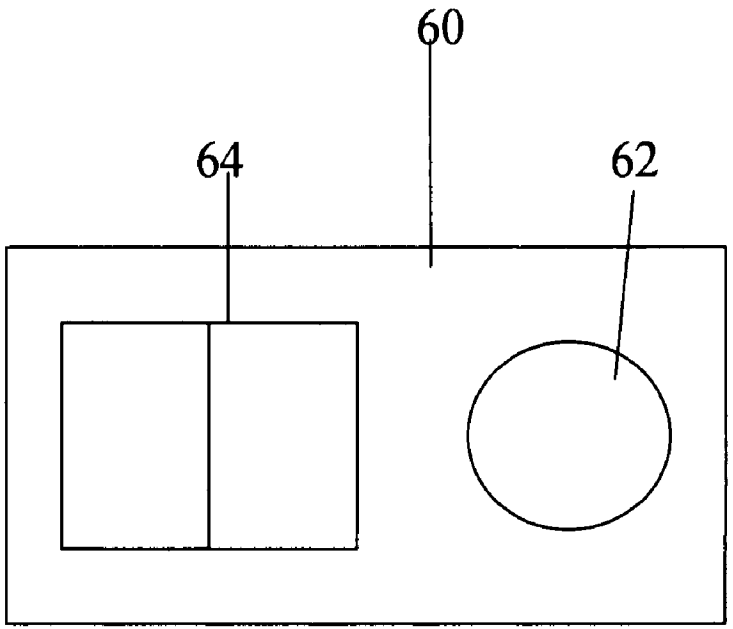
FIG. 9 illustrates an integrated construction of a start of scan and a position detector for placing on the PIP or in its conjugate plane.

Reference is now made to FIG. 9, which is a simplified diagram illustrating a combined element which integrates the start of scan detector with the position detector. Combined element 60 includes in a single manufactured element a start of scan detector 62 and a position detector 64. Integrating the two onto a single manufactured element simplifies building the system since the relative position between the start of scan detector and the position detector is already constructed. In one embodiment a single sensor may carry out both tasks.

Figure 10:
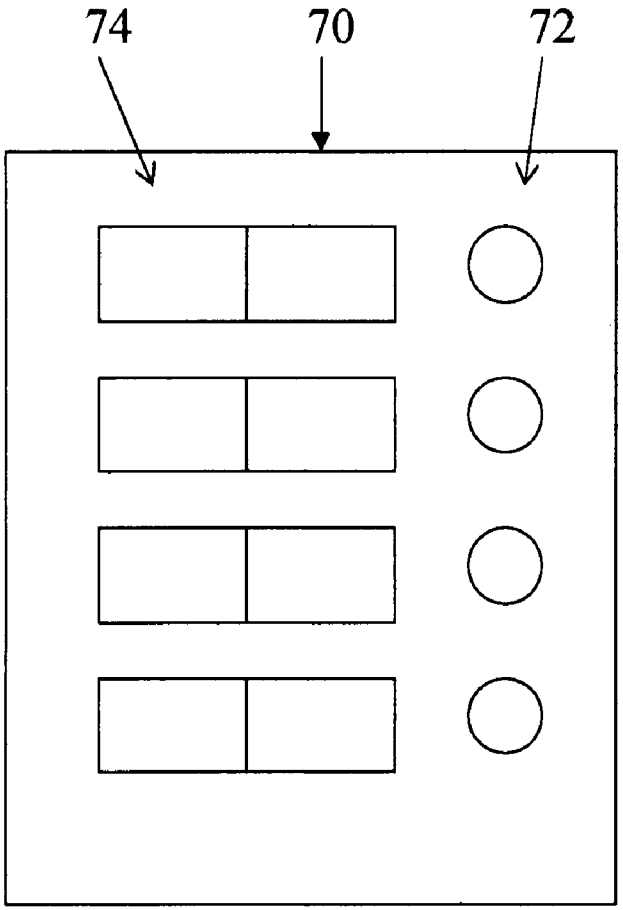
FIG. 10 illustrates an integrated construction of several start of scan and position detectors.

Reference is now made to FIG. 10, which shows a combined element that includes start of scan detectors and position detectors for each beam. Combined element 70 includes in a single manufactured element a column 72 of start of scan detectors located opposite a similar column 74 of position detectors. Integrating the two rows onto a single manufactured element further simplifies building of the system since the relative positions between all of the start of scan detectors and the position detectors is already constructed into the element.

Figure 11:
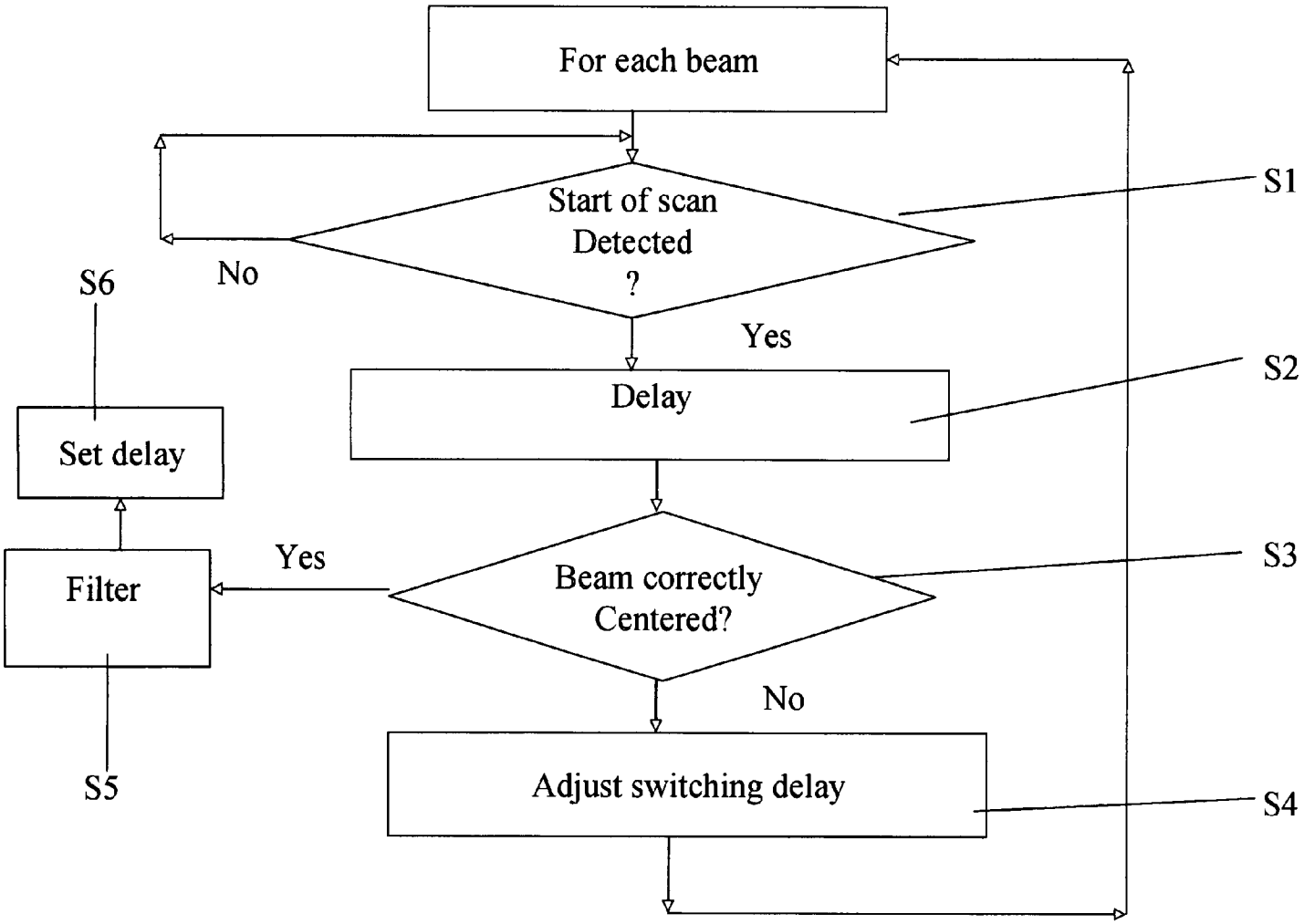
FIG. 11 is a simplified flow chart illustrating a procedure for measuring a skew and compensating therefor in accordance with a second embodiment of the present invention.

Reference is now made to FIG. 11, which is a simplified flow chart illustrating a procedure for skew compensation of a given beam according to an embodiment of the present invention. In FIG. 11 a start of scan signal is detected in stage S1 for a given beam. The beam is switched in stage S2 and if the skew is correctly compensated for then the beam will land exactly in the center of the position detector. If this happens then no further compensation is required. However if the beam does not land directly in the center of the position detector, stage S3, then a delay to the switching is either increased or decreased depending on the direction of skew, stage S4. Once the beam is correctly centered then the delay is fixed for that beam, at least until the next calibration operation. The compensating electronics operates during the calibration process to alter the beam switching delay in an iterative procedure to converge on a compensation solution, that is the position at which the beam is correctly compensated.

It will be appreciated that compensation may be carried out for each beam in parallel as each beam is scanned one after the other so that scan no. 1 is completed for each beam before scan no. 2 has begun for any beam.

The calibration operation may be carried out as often as required since the hardware for compensation is built in the writing head or other location within the printer. In one embodiment the compensation operation is carried out automatically upon power up of the printing machine. Alternatively it may be carried out during printing or between printing.

It is expected that during the life of this patent many relevant scanning devices and systems will be developed and the scope of the corresponding terms herein, is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. Skew compensation apparatus for compensating for skew of multiple beams of a multi-beam scanning source, the apparatus comprising:

a delay commencement detector for detecting a predetermined scan commencement indication therefrom to measure a delay, a position detector for detecting the position of at least one of said multiple beams after said delay, said position thereby indicating a skew of said beam, and compensating electronics for automatically inserting a compensation for said skew by altering said delay following said scan commencement, wherein said compensating electronics is configured to carry out said compensating by iteratively varying said delay.

2. Skew compensation apparatus according to claim 1, wherein said delay commencement detector is a start of scan detector.

3. Skew compensation apparatus according to claim 2, wherein said delay commencement indication is an arrival of a start of scan beam at a start of scan detector.

4. Skew compensation apparatus according to claim 1, wherein said position detector is located in a focal plane of said multi-beam scanning source.

5. Skew compensation apparatus according to claim 1, wherein said position detector is a split detector or a charge coupled device or a photodiode.

6. Skew compensation apparatus according to claim 5, wherein said split detector is centered on a position definitive of full compensation of a respective beam for said skew.

7. Skew compensation apparatus according to claim 1, wherein said compensating electronics is configured to vary said delay until said position coincides with a predetermined position indicative of zero skew.

8. Skew compensation apparatus for compensating for skew of multiple beams of a multi-beam scanning source, the apparatus comprising:

a delay commencement detector for detecting a predetermined scan commencement indication therefrom to measure a delay, a position detector for detecting the position of at least one of said multiple beams after said delay, said position thereby indicating a skew of said beam, and compensating electronics for automatically inserting a compensation for said skew by altering said delay following said scan commencement;

wherein there is provided a plurality of position detectors, one for each beam of said multi-beam scanning source.

9. Skew compensation apparatus according to claim 8, wherein each position detector is centered on a position indicative of zero skew.

10. Skew compensation apparatus according to claim 1, configured for automatic use as a calibration operation prior to scanning.

11. Skew compensation apparatus according to claim 1, wherein said delay commencement detector is located on a conjugate plane associated with a photo imaging plate (PIP) towards which said multiple beams are directed.

12. Skew compensation apparatus according to claim 11, wherein said position detector is located on said conjugate plane.

13. Skew compensation apparatus according to claim 11, wherein said position detector is located integrally with said delay commencement detector.

14. Skew compensation apparatus according to claim 11 wherein said position detector and said delay commencement detector are incorporated into a single sensor.

15. Skew compensation apparatus according to claim 11, wherein said position detector is a split detector and is located integrally with said delay commencement detector.

16. Skew compensation apparatus according to claim 1, wherein said multi-beam scanning source is a laser printer scanning source.

17. A method of skew compensation for scan beams in a multi-beam scanning apparatus, the method comprising:

for each beam detecting a start of beam switching event;

measuring a position of a respective beam a predetermined time after said start of beam switching event; and altering a switching delay for said respective beam until said measured position is such as to indicate that skew in said beam has been compensated for by iteratively varying the switching delay.

18. Skew compensation apparatus for compensating for skew of one or more beams of a beam scanning source, the apparatus comprising:

delay commencement detection means for detecting an indication of a commencement of a scan operation, position detection means for detecting the position of said one or more beams at a predefined interval following said commencement, said position indicating a skew of said beam, and compensating means for automatically inserting a compensation for said skew, therewith to alter said predefined interval by iteratively varying a delay.

* * * * *